US005417765A

United States Patent [19]

Otani et al.

[11] Patent Number: 5,417,765

[45] Date of Patent: May 23, 1995

[54] APPARATUS FOR CLEANING A POWDER COATING BOOTH

[75] Inventors: Tatsuo Otani, Yokohama; Hidetaka Tsukamoto, Osaka, both of Japan; Richard C. Morgan, Bay Village, Ohio; Joseph A. Laubenthal, Elyria, Ohio

[73] Assignee: Nordson Corporation, Westlake, Ohio

[21] Appl. No.: 85,411

[22] Filed: Jun. 30, 1993

[30] Foreign Application Priority Data

Jul. 1, 1992 [JP] Japan ..... 4-197524

[51] Int. Cl.[6] ..... B05C 15/00; B05B 13/00

[52] U.S. Cl. ..... 118/314; 118/315; 118/324; 118/326

[58] Field of Search ..... 118/70, 326, 309, 314, 118/315, 316, 324; 182/63, 69, 141

[56] References Cited

U.S. PATENT DOCUMENTS

| | | | |
|---|---|---|---|
| 2,730,988 | 1/1956 | Starkey | 118/320 X |
| 2,757,597 | 8/1956 | Ward et al. | 118/326 X |
| 3,961,681 | 6/1976 | Fisher | 182/63 X |
| 4,069,790 | 1/1978 | Witte | 118/70 |
| 4,175,644 | 11/1979 | Sikli | 187/18 |
| 4,266,504 | 5/1981 | Roesner | 118/663 |
| 4,338,958 | 7/1982 | Fujita | 134/104 |
| 4,356,887 | 11/1982 | Fisher et al. | 182/63 |
| 4,425,868 | 1/1984 | Shapiro | 118/314 |
| 4,430,956 | 2/1984 | Koch | 118/326 |
| 4,890,692 | 1/1990 | Oakman | 182/141 |
| 4,930,598 | 6/1990 | Murrill et al. | 182/63 |
| 4,931,322 | 6/1990 | Yamamoto et al. | 427/421 |
| 5,145,029 | 9/1992 | Blasdell et al. | 182/63 |
| 5,275,659 | 1/1994 | Shutic et al. | 118/315 |

FOREIGN PATENT DOCUMENTS 2230715 10/1990 United Kingdom .

*Primary Examiner*—Lyle A. Alexander
*Assistant Examiner*—Harold Y. Pyon
*Attorney, Agent, or Firm*—Wood, Herron & Evans

[57] ABSTRACT

An apparatus for cleaning a powder coating booth used to coat elongated articles while oriented vertically includes a pair of opposing vertical walls forming a coating booth, powder spray guns extending through the walls to powder coat articles located therebetween and an overhead conveyor for carrying the elongated articles along a coating line between the walls. A platform mounted to an elevator is vertically movable to any desired elevation in the booth, thereby to enable a cleaning person to clean accumulated powder from the inner surfaces of the walls after a job is finished or when a new color is used. The platform and elevator may be located below the booth, along the coating line. Alternatively, the platform and elevator may be located at a cleaning station away from the coating line and the booth moved to the cleaning station on a wheel-supported rack. With additional booths or cleaning stations, booths may be cleaned while other booths are used for coating, thereby to reduce downtime for the coating line.

12 Claims, 8 Drawing Sheets

APPARATUS FOR CLEANING A POWDER COATING BOOTH

FIELD OF THE INVENTION

This invention relates to powder coating, and more particularly, to a method and apparatus for cleaning a powder coating booth used to coat elongated articles in vertical orientation.

BACKGROUND OF THE INVENTION

Powder coating of articles provides advantages over other types of painting or coating. For safety reasons, and to collect excess particles which deflect off of articles during powder coating, powder coating typically occurs within a booth.

For relatively long articles such as extrusions, which may have a length of 20 to 30 feet, or even longer, it is advantageous to coat these articles while oriented vertically. In one approach to coating articles of this type, an overhead conveyor holds the articles in vertical orientation and conveys them in a horizontal direction through a powder booth which, in cross section, resembles a keyhole. In this approach, the powder booth must be at least as tall as the elongated articles.

During powder coating in a booth of this type, a substantial amount of powder sticks and accumulates to the inner walls. This powder must be cleaned from the inner walls of the booth when a particular job has been completed, or when the booth is changed over to coat with a different color. Because these keyhole shaped powder booths sometimes have a height as high as five (5) meters, it is necessary for a cleaning person to use a stepladder to clean the inner walls at the top of the booth. Using a stepladder, typical cleaning time for a booth of this type is about six hours. During this time, the powder booth cannot be operated.

In addition to this excessive downtime, cleaning efficiency is relatively low and risk to the operator is relatively high when cleaning is performed from a stepladder, due to the narrow dimensions of the booth. These factors result in cost increases in operating a powder coating booth for coating elongated articles.

As an alternative to a stepladder, a wheel supported crane, or "cherrypicker", could be used to elevate a cleaning person to the level necessary to clean the inner walls of a powder booth. However, such devices are expensive and difficult to maneuver within the confines of a typical manufacturing facility in which powder coating is performed.

It is an objective of this invention to simplify and to increase the safety level of cleaning the inner walls of a powder booth used to coat elongated articles.

It is another objective of this invention to reduce the costs associated with operating an apparatus for powder coating elongated articles.

It is still another objective of this invention to reduce the downtime normally associated with cleaning a powder coating apparatus.

The above-stated objectives are achieved via a powder coating booth equipped with an elevator which supports a horizontal platform within the booth and raises or lowers the platform to any desired elevation in the booth so that an operator standing on the platform can efficiently wipe clean the inner surface of the walls of the booth at any desired elevation.

According to one preferred embodiment of the invention, a powder coating apparatus includes a conveyor for conveying elongated articles along a coating line in vertical orientation, a pair of opposing walls which define the body of a powder booth centered on the coating line, powder spray nozzles extending through the walls and directed toward the coating line, and an elevator adapted to move a horizontal platform upward and downward to a desired elevation inside the booth. The platform is slightly undersized with respect to the distance between the walls of the powder booth, thereby enabling the platform to raise and lower without obstruction. The walls of the booth include opposing guide rails, and the platform includes horizontal slides which ride within the rails during vertical movement.

The elevator may include a hydraulic cylinder operatively connected to a pantograph linkage that supports the bottom of the platform. A number of other mechanisms may be used to raise and lower the platform, including a rack and pinion, a nut and bolt, a swinging arm, or any other suitable structure for vertically moving a horizontal platform. The particular application of the invention will dictate the preferable elevator structure for vertically moving the platform.

In operation, an overhead conveyor conveys the elongated articles along the coating line. The walls of the powder booth straddle the line. At a portion of the line dedicated to article coating i.e., a coating station, the spray gun nozzles extend through the walls of the powder booth and are directed inwardly toward the articles to spray powder thereon.

When excessive powder has accumulated on the inner walls of the powder booth, or when a job has been completed or the powder used in the coating operation is changed to a new color, the walls of the powder booth must be cleaned.

The location for cleaning depends upon the particular embodiment of the invention. If the powder booth and the platform/elevator are not horizontally movable, cleaning occurs at the same location as coating, but when the conveyor and coating line has been shut down. For this embodiment, the elevator may be recessed in the floor.

Several other embodiments of the invention utilize one or more cleaning stations laterally spaced away from the coating station and the coating line. The use of a spatially removed coating station in combination with a horizontally movable booth allows the coating line to operate almost continuously, or with reduced downtime needed for cleaning. For these embodiments, the spray guns are preferably mounted to brackets which are also horizontally movable. If desired, the platform and elevator may also be horizontally movable to the one or more cleaning stations.

Optimum efficiency for the coating line may be achieved with multiple movable powder booths, multiple coating stations, multiple cleaning stations, multiple stationary elevators, at least one horizontally movable elevator, or even with multiple coating lines, depending upon the circumstances.

The use of a vertically movable elevator within a powder booth reduces the time associated with cleaning a powder booth. Using the elevator, a wiping operation to clean the walls of the booth takes about two hours. The elevator also makes cleaning the walls of the booth a simpler and safer operation, compared to using a stepladder. Use of a cleaning elevator in conjunction with multiple powder booths reduces the downtime of a powder coating line used to coat elongated articles, thereby reducing the costs associated therewith.

These and other features of the invention will be more readily understood in view of the following detailed description and the drawings.

DETAILED DESCRIPTION OF THE DRAWINGS

Figure 1:
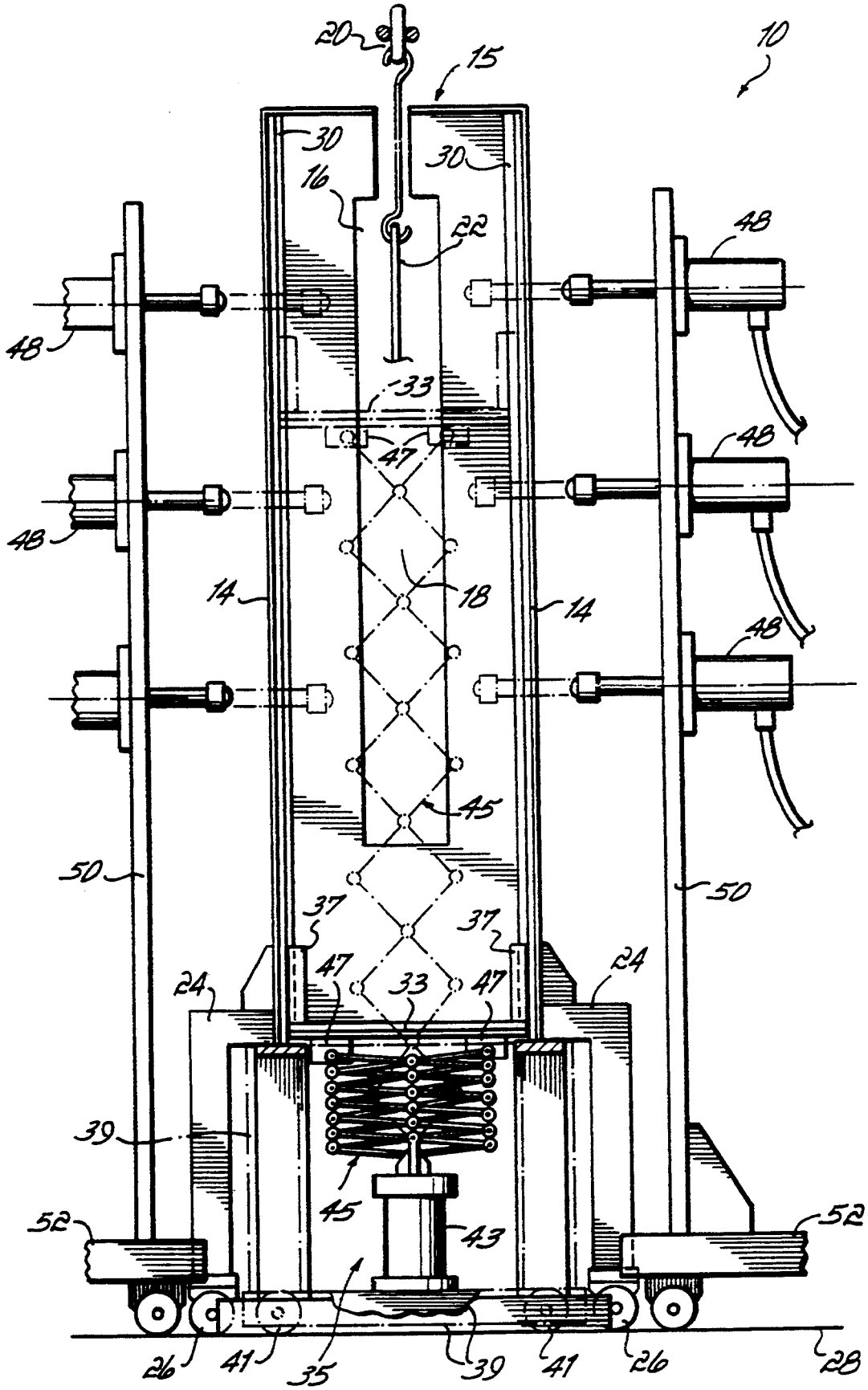
FIG. 1 is a transverse cross-sectional view of a powder coating apparatus in accordance with a first preferred embodiment of the invention.

FIG. 1 depicts a first preferred embodiment of the invention. A powder coating apparatus 10 includes a pair of spaced, opposing walls 14 which form a powder coating booth 15 and which define a keyhole shaped space 16 therebetween, as viewed in transverse cross-section. An overhead conveyer 20 resides above the space 16 and conveys elongated articles 22 therethrough between the walls 14 of the booth 15, along a coating line 18. Preferably, the walls 14 of the powder booth 15 are mounted to a rack 24, which is supported by wheels 26 above floor 28.

The walls 14 of the powder booth 15 include spaced and aligned sets of vertical guide rails 30. A horizontally oriented platform 33 resides on top of an elevator 35, which is adapted to raise or lower the platform 33 to a desired elevation within the booth 15. Platform 33 includes slides 37 which ride within the vertical guide rails 30. The number of sets of guide rails 30 and slides 37 will depend upon the length of the conveyor line 20 needed for powder coating.

As shown in FIG. 1, platform 33 and elevator 35 are carried by a rack 39 supported above the floor 28 by wheels 41. More particularly, the rack 39 supports cylinder 43, which may be oil or gas powered, and the cylinder 43 operatively connects to a pantograph linkage 45 with multiple links and hinges. The uppermost portion of the pantograph linkage 45 connects to sliders 47 which coact with the bottom surface of the platform 33. The platform 33 rests on top of the rack 39 when it is not in use.

Figure 2:
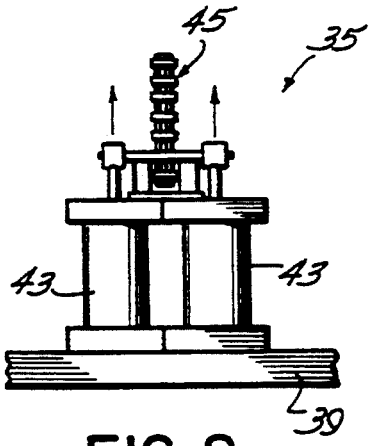
FIG. 2 is a side view of an elevator used in one variation of the powder coating apparatus depicted in FIG. 1.
Figure 3:
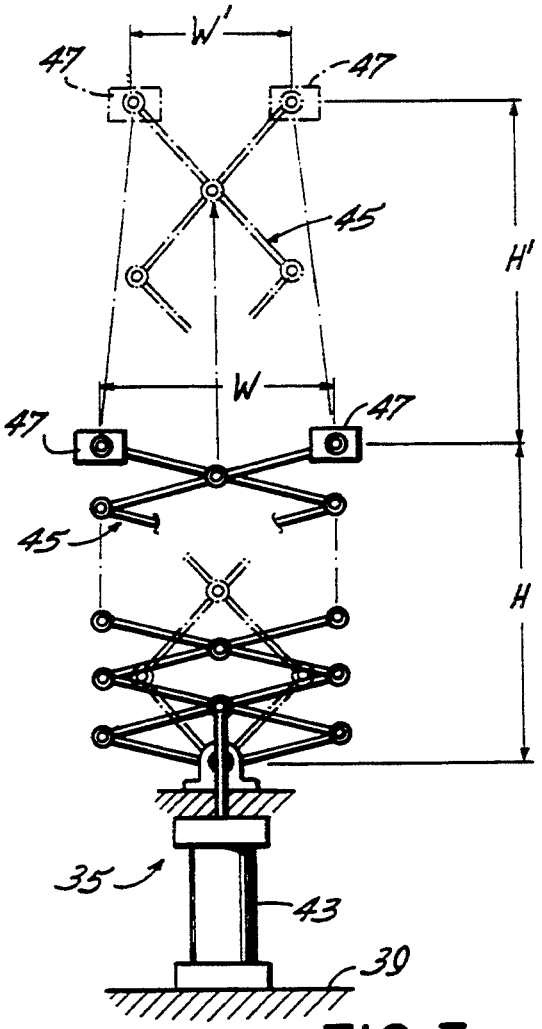
FIG. 3 is a side view which illustrates the operation of the elevator depicted in FIG. 2.

FIGS. 2 and 3 show more specific details of the elevator 35, particularly the operation of the cylinder(s) 43 and the pantograph linkage 45 for raising and lowing the horizontal platform 33 to a desired vertical elevation within the powder booth 10. FIG. 3 shows that the sliders 47 of the pantograph linkage 45 move from a height H to a height H+H' and that the horizontal spacing between the sliders 47 decreases from W to W' during raising.

Powder coating gun nozzles 48 mount to brackets 50 supported on movable racks 52. The gun nozzles 48 may be horizontally moved to extend through apertures (not shown) in the walls 14 to direct powder inwardly at articles 22 moved along the coating line 18 by the conveyor 20.

FIG. 1 depicts a powder booth 15 which is horizontally movable, due to wheels 26, a platform 33 and elevator 35 which are horizontally movable, due to wheels 41, and powder guns 48 which are horizontally movable. However, the advantages of this invention do not require that all of these components be movable. The circumstances of each use of the invention will dictate the need for mobility of the powder booth 15, the platform 33 and elevator 35, and the powder guns 48, and interconnection therebetween. However, it is preferable that the brackets 50 for mounting the powder guns 48 be inwardly movable toward the coating line 18 to locate the powder guns 48 in a position to extend through the walls 14 during coating. Moreover, the powder booth rack 24 should be sized to straddle the rack 39 which supports the platform 33 and elevator 35. The brackets 50 should be sized to be located outside the rack 24. If desired, the outer rack 24, the inner rack 39 and brackets 50 may be connectable. Rack 24 may also accommodate a dust collector, not shown.

Figure 4:
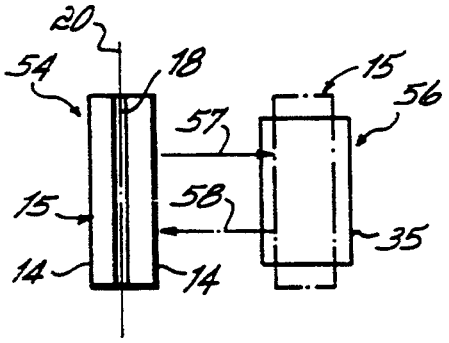
FIG. 4 is a schematic plan view which illustrates the invention utilizing one coating station, one cleaning station and one movable powder booth.

FIG. 4 illustrates the advantages of the invention with respect to use of a single mobile powder booth 15. More particularly, FIG. 4 shows the coating line 18, a coating station 54 on the line 18 and a cleaning station 56 removed laterally from the line 18. When powder has accumulated on the inner surfaces of the walls 14 of the powder booth 15, or when a job has been completed, or changeover to a new color is needed, the conveyor 20 is stopped, and the powder booth 15 is moved from coating station 54 to cleaning station 56, as shown by directional arrow 57. Lateral movement of the powder booth 15 does not interfere with the conveyer 20 or the coating line 18 because the conveyor 20 is located above the tops of the walls 14 of the booth 15, and movement of the booth 15 from the coating line 18 occurs when no articles 22 are located between the walls 14. When located at the cleaning station 56, the powder booth 15 is arranged such that the platform 33 is located between the walls 14, and elevator 35 is operated to selectively move the platform 33 to the desired elevations within the booth 15, thereby to facilitate cleaning thereof (FIG. 1). After cleaning, the booth 15 is moved back to the coating line 18, as shown by directional arrow 58.

With the embodiment of the invention depicted in FIG. 4, it is not necessary that the platform 33 and elevator 35 be horizontally movable.

Figure 5:
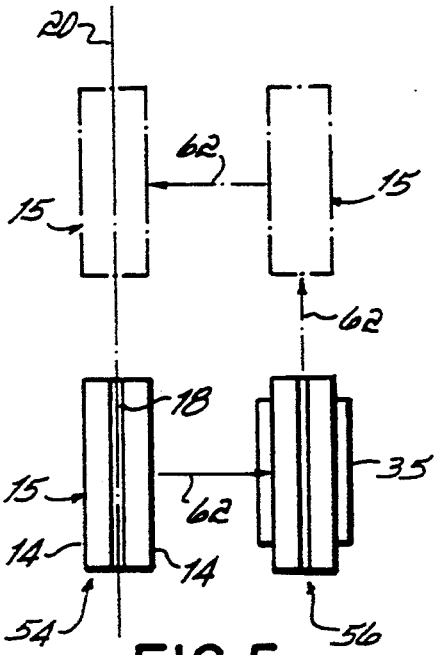
FIG. 5 is a schematic plan view, similar to FIG. 4, which illustrates the invention utilizing one coating station, one cleaning station and two movable powder booths.

FIG. 5 illustrates another variation of the invention depicted in FIG. 4. Namely, FIG. 5 illustrates the advantages of using two movable powder booths 15. With two booths 15, one may be located at the coating station 54 while the other is located at the cleaning station 56. This reduces downtime of the coating line 18 because the powder booths 15 are cleaned when they are off the coating line 18. Directional arrows 62 schematically illustrate counterclockwise movement of the two powder booths 15 in this manner. Again, platform 33 and elevator 35 may be either stationary or movable.

Figure 6:
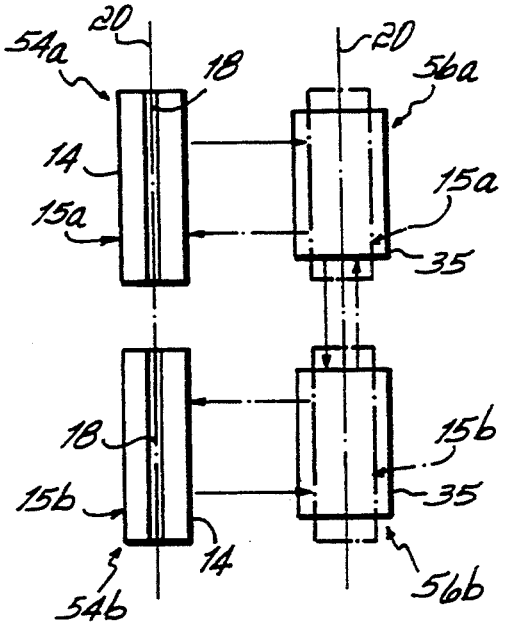
FIG. 6 is a schematic plan view, similar to FIGS. 4 and 5, which illustrates the invention utilizing two coating stations, two cleaning stations and two powder coating booths.

FIG. 6 illustrates a further variation of the invention depicted FIGS. 4 and 5. Namely, FIG. 6 illustrates the use of two coating stations 54*a* and 54*b* located alongside two cleaning stations 56*a* and 56*b* in conjunction with two powder booths 15*a* and 15*b*. By using one of two such stations 54*a* or 54*b* to perform the same coating operation upon articles 22 conveyed along the coating line 18, the stations 54*a* and 54*b* may be alternated to optimize the efficiency of the coating line 18. For instance, powder booth 15*a* is used to coat articles 22 at coating station 54*a* while powder booth 15*b* is cleaned at cleaning station 56*b*. Similarly, when booth 15*a* is cleaned at cleaning station 56*a*, booth 15*b* is used for coating operations at coating station 54*b*.

With this variation of the invention, it is advantageous to utilize a movable platform 33 and elevator 35, so that a single elevator 35 may be moved back and forth between the two cleaning stations 56*a* and 56*b*. Alternatively, two stationary platform 33 and elevator 35 combinations may be used, one located at each of cleaning stations 56*a* and 56*b*.

Figure 7:
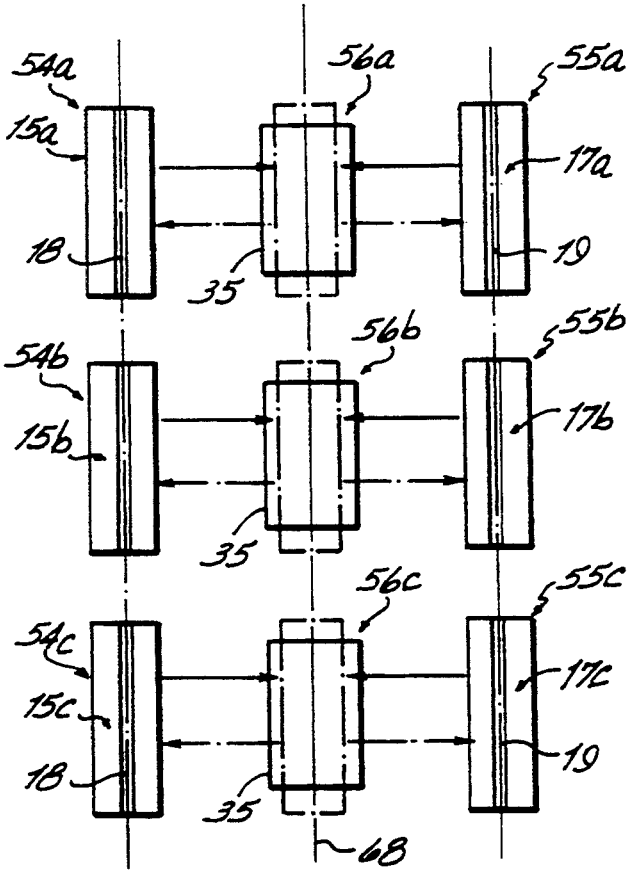
FIG. 7 is a schematic plan view, similar to FIGS. 4, 5 and 6, which illustrates the invention utilizing two coating lines, three coating stations on each line, three cleaning stations and six movable powder booths.

FIG. 7 illustrates a further variation of this embodiment of the invention. Namely, FIG. 7 shows two coating lines 18 and 19 located on opposite sides of a cleaning line 68 of cleaning stations 56. The coating line 18 includes coating stations 54*a*, 54*b* and 54*c*, and coating line 19 includes coating stations 55*a*, 55*b* and 55*c*. The cleaning line 68 includes cleaning stations 56*a*, 56*b* and 56*c*. The powder booths 15*a*, 15*b* and 15*c* are used on line 18 for coating stations 54*a*, 54*b* and 54*c*, respectively. Similarly, powder booths 17*a*, 17*b* and 17*c* are used at coating stations 55*a*, 55*b* and 55*c*, respectively. These powder booths are moved laterally from one of coating lines 18 or 19 toward cleaning line 68 to one of the cleaning stations 56*a*, 56*b* and 56*c* to allow cleaning of the inner walls 14. If desired, a single movable platform 33 and elevator 35 may be moved between cleaning stations 56*a*, 56*b* and 56*c* to accommodate cleaning of all the powder booths 15 used at the six stations. Alternatively, additional platforms 33 and elevators 35 may be used, either stationary or mobile.

Together, FIGS. 4, 5, 6 and 7 illustrate the versatility which is achieved by mounting the powder booth 15 to a movable rack 24 which is sized to straddle and connectable to the rack 39 which supports the platform 33 and the elevator 35 (FIG. 1). As shown in FIGS. 5, 6 and 7, additional advantages may also be achieved if rack 39 is horizontally movable, and/or if the apparatus 10 includes multiple coating stations 54, multiple cleaning stations 56 and even multiple coating lines 18, 19.

Figure 8:
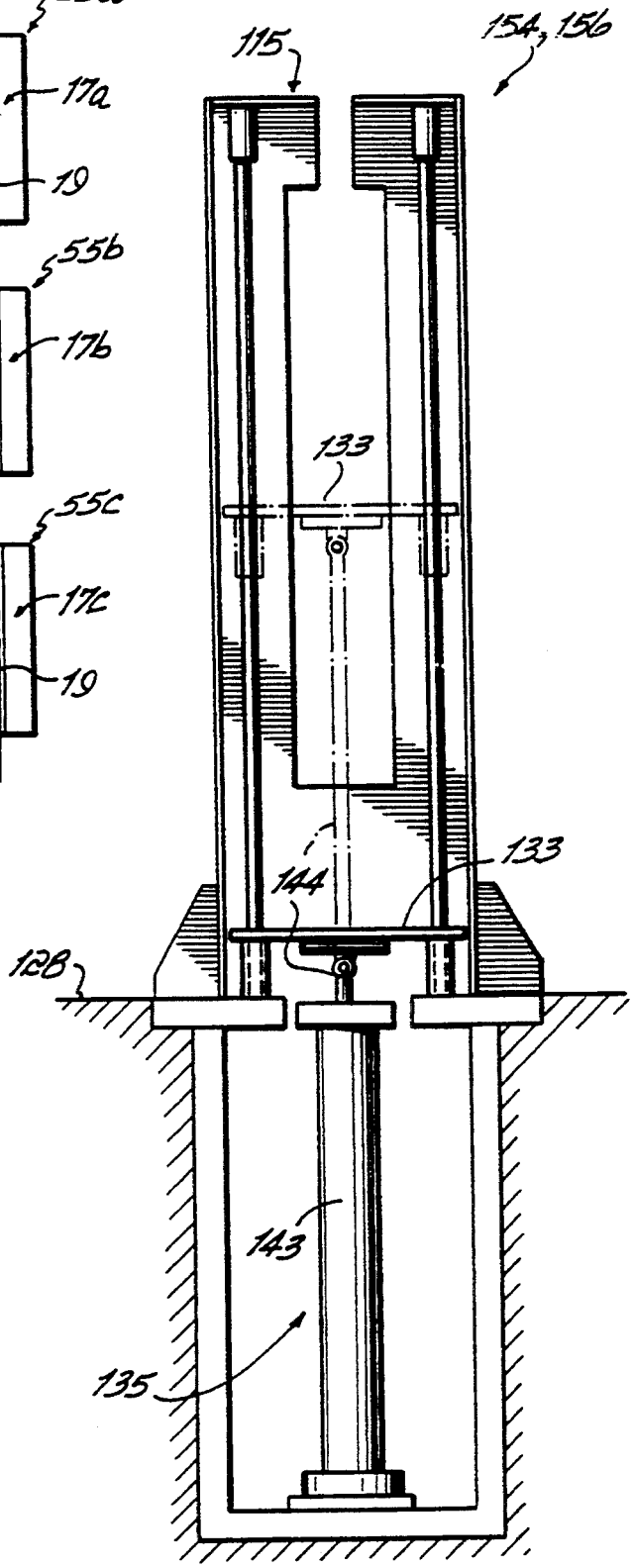
FIG. 8 is a transverse cross-sectional view, similar to FIG. 1, depicting a second preferred embodiment of the invention.

FIG. 8 depicts a second preferred embodiment of the invention, wherein the platform 133 is vertically movable via a stationary elevator 135. The stationary elevator 135 comprises a cylinder 143 recessed within the floor 128 below the powder booth 115. The cylinder 143 drives a piston 144. In this embodiment of the invention, the coating station 154 and the cleaning station 156 are one and the same because both operations occur at the same place.

Figure 9:
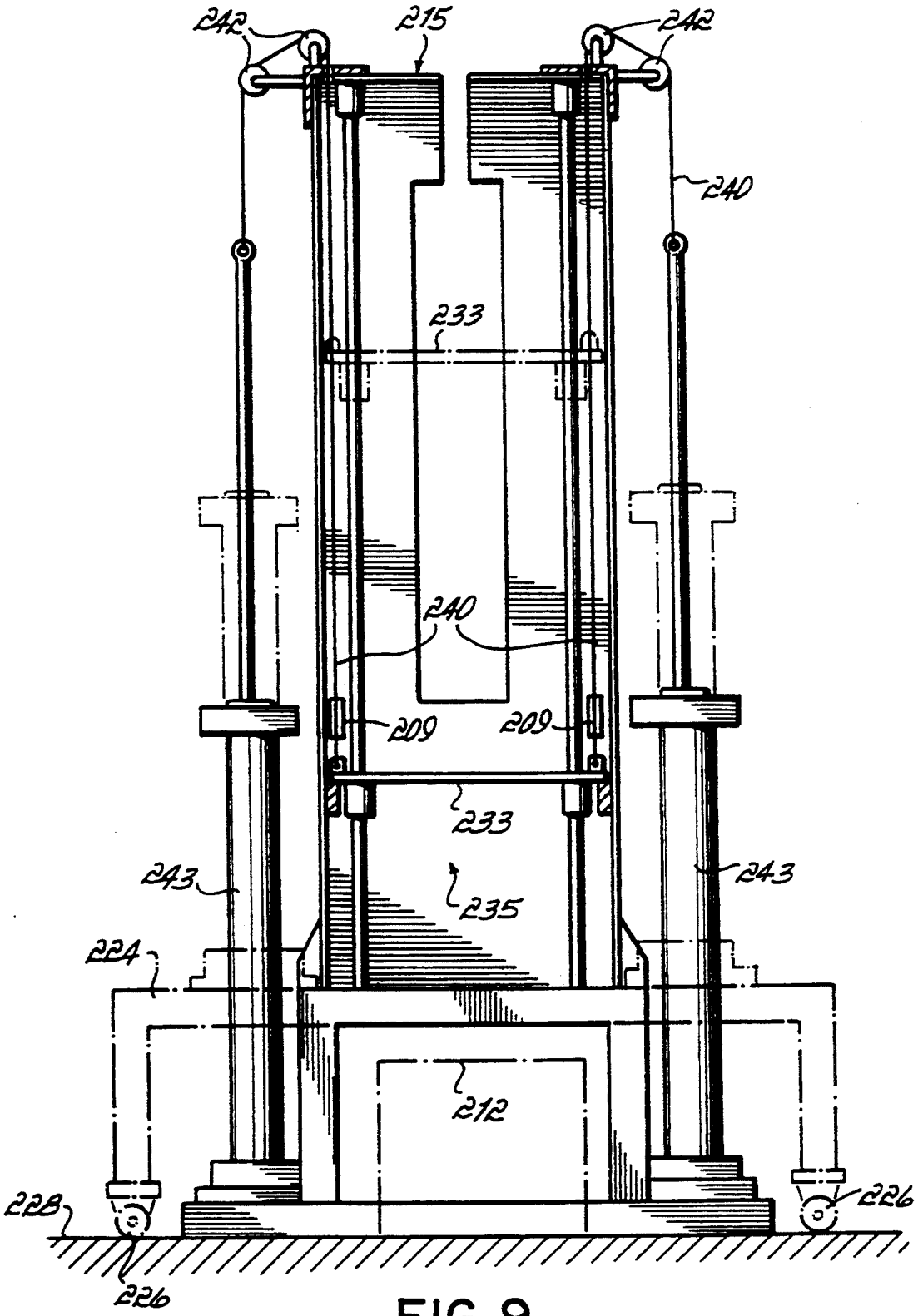
FIG. 9 is a transverse cross-sectional view, similar to FIGS. 1 and 8, depicting a first variation of the second preferred embodiment of the invention.

FIG. 9 depicts a first variation of the second preferred embodiment of the invention shown in FIG. 8. More particularly, FIG. 9 depicts platform 233 moved vertically by an elevator 235 that is located above the floor 228. The powder booth 215 is mounted to a rack 224 supported by wheels 226 above the floor 228. The rack 224 horizontally moves the powder booth 215 to a cleaning station, which is preferably spaced from the coating station, though this is not absolutely necessary. Elevator 235 comprises cylinders 243 which connect to the platform 233 via cables 240 and pulleys 242 to affect vertical movement thereof. The cylinders 243 are located outside of the booth 215. A dust collector 212 may be located below the elevator 235. Turnbuckles 209 are used to adjust the tension of the cables 240.

Figure 10:
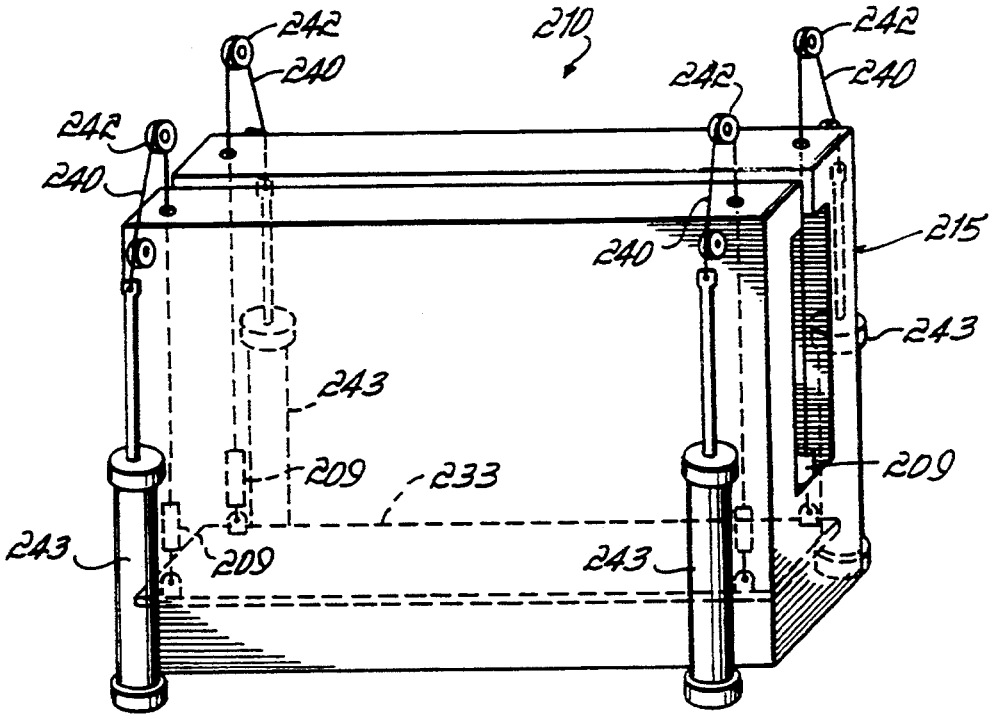
FIG. 10 is a perspective view of the powder booth elevator shown in FIG. 9.

FIG. 10 shows a perspective view of the apparatus 210 of FIG. 9, with four cylinders 243 and four cable 240 and pulley 242 arrangements connected to the four corners of the platform 233.

Figure 11:
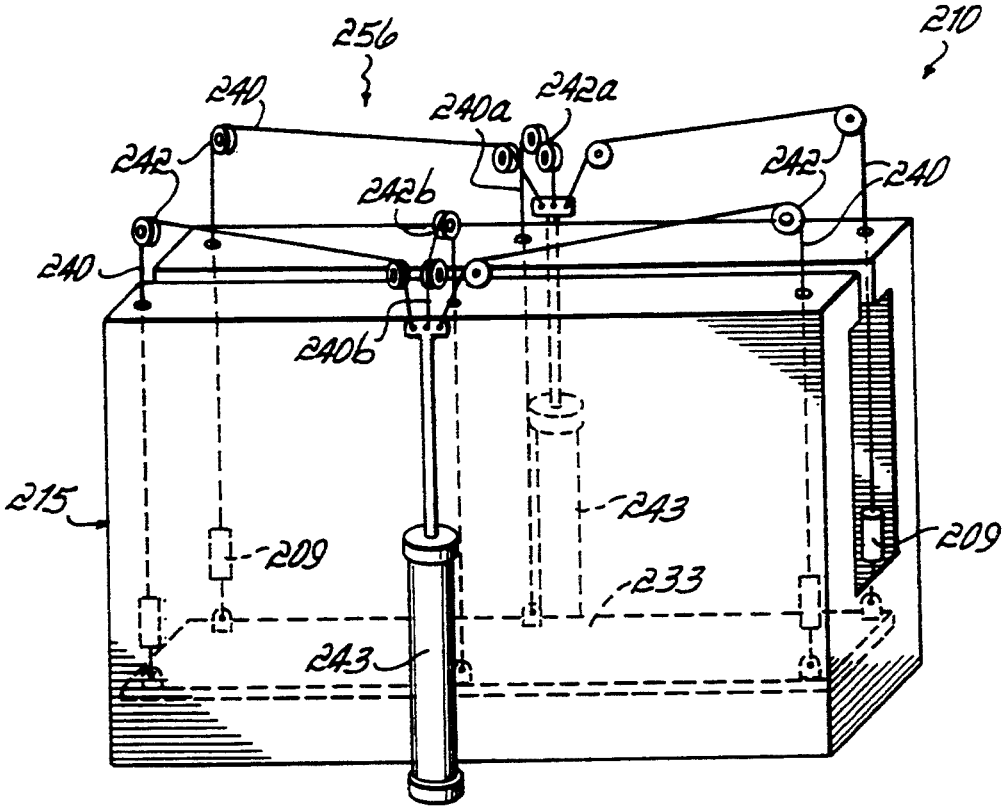
FIG. 11 is a perspective view, similar to FIG. 10, depicting a second variation of the second preferred embodiment of the invention.

FIG. 11 shows a second variation of the second preferred embodiment of the invention depicted in FIGS. 9 and 10. More particularly, in FIG. 11 two cylinders 243 are used along the sides of the cleaning station 256, rather than four cylinders located at the corners of the cleaning station 256. With the arrangement depicted in FIG. 11, an additional centrally located set of pulleys and cables is necessary, designated by numerals 242*a* and 242*b*, and 240*a* and 240*b*, respectively. This arrangement is used if the coating station and booth 215 are relatively long.

Figure 12:
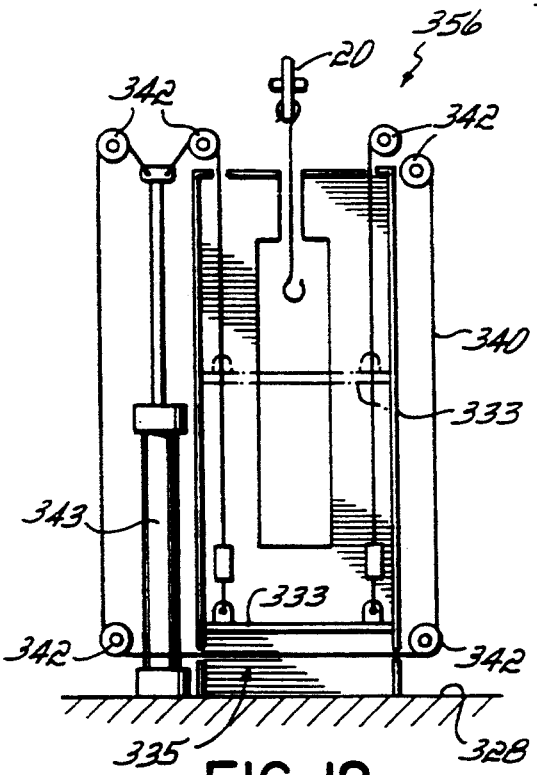
FIG. 12 is a transverse cross-sectional view depicting a third variation of the second preferred embodiment of the invention.

FIG. 12 shows a third variation of the second preferred embodiment of the invention. More particularly, FIG. 12 shows an elevator 335 for raising platform 333 which comprises a pulley 342 and cable 340 arrangement which interconnects with one or more cylinders 343 located on a single side of the cleaning station 356. In this variation, part of the cable 340 extends below the platform 333. All of the components of the elevator 335 are located above the floor 328.

Figure 13:
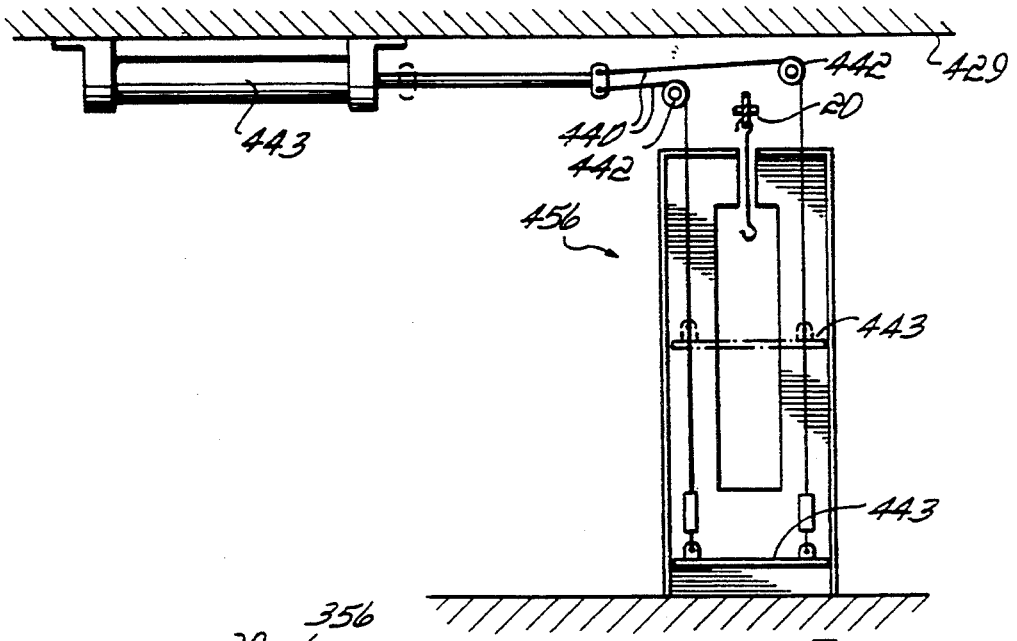
FIG. 13 is a transverse cross-sectional view depicting a fourth variation of the second preferred embodiment of the invention.

FIG. 13 shows a fourth variation of the second preferred embodiment of the invention. Like the third variation shown in FIG. 12, the fourth variation shown in FIG. 13 includes one or more cylinders 443 located on a single side of the cleaning station 456. However, the cable 440 and pulley 442 arrangement does not extend below the platform 443. Moreover, cylinder 443 is mounted horizontally, to a ceiling 429 of the facility.

Figure 14:
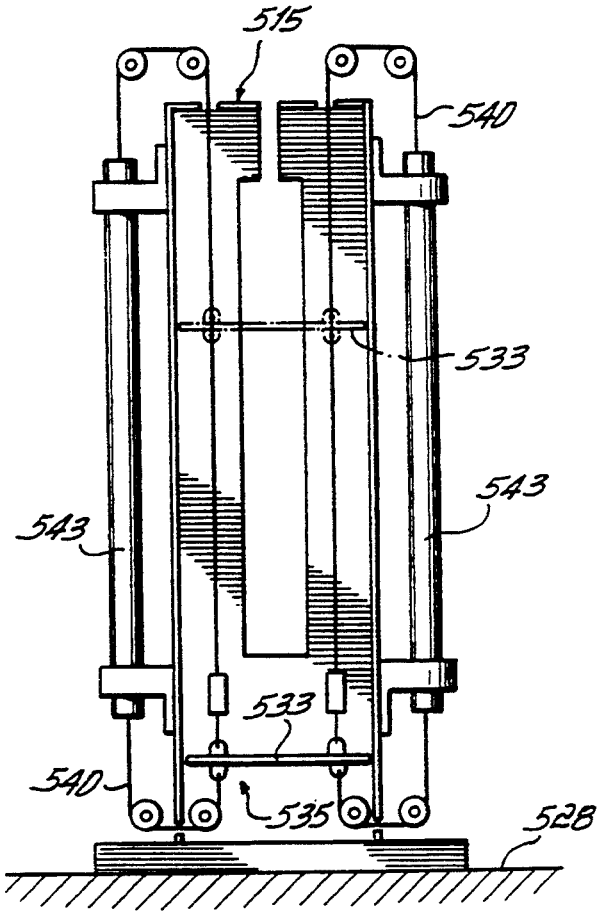
FIG. 14 is a transverse cross-sectional view depicting a fifth variation of the second preferred embodiment of the invention.

FIG. 14 depicts a fifth variation of the second preferred embodiment of the invention. In this variation, the elevator 535 for moving the platform 533 is located above the floor 528. The cylinders 543 are mounted to the outer walls of the booth 515 and the cables 540 extend above and below the powder booth 515 and connect to the top and the bottom of the platform 533.

Figure 15:
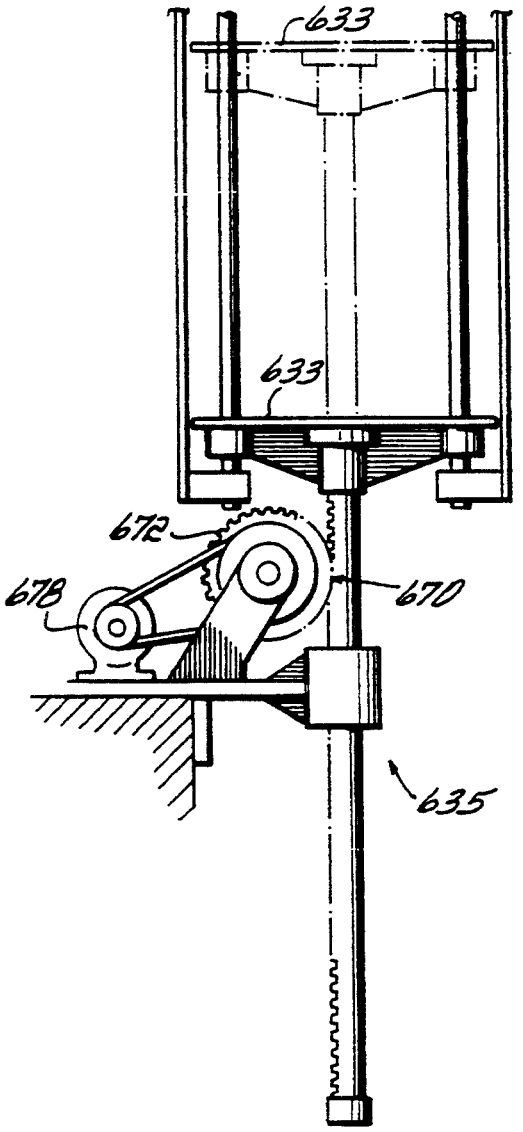
FIG. 15 is a transverse cross-sectional view depicting a third preferred embodiment of the invention.

FIG. 15 depicts a third preferred embodiment of the invention. In this embodiment, platform 633 is moved by an elevator 635 which comprises a rack and pinion mechanism 670. The pinion 672 connects to the bottom of the platform 633. The pinion 672 is driven upwardly or downwardly by operation of motor 678, thereby to raise or lower the platform 633.

Figure 16:
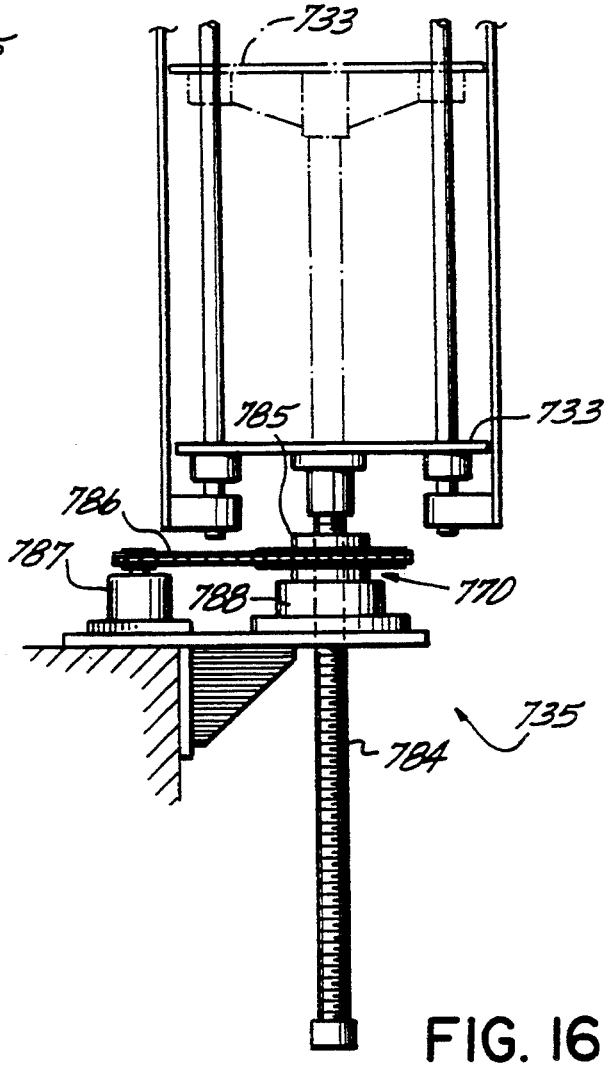
FIG. 16 is a transverse cross-sectional view depicting a fourth preferred embodiment of the invention.

FIG. 16 depicts a fourth preferred embodiment of the invention. In this embodiment, the platform 733 is vertically moved by an elevator 735 which comprises a nut and bolt mechanism 770. This mechanism includes an externally threaded vertical member or bolt 784 connected to the bottom of platform 733. The threads of bolt 784 mesh with internal threads of a nut 785 rotatably driven via a belt 786 connected to a motor 787. A mounting bracket 788 holds the nut and bolt mechanism 770 in horizontal alignment with the platform 733. Operation of the motor 787 rotates the nut 785 and thereby raises or lowers the bolt 784, due to intermeshing of threads therebetween, which results in raising or lowering platform 733.

Figure 17:
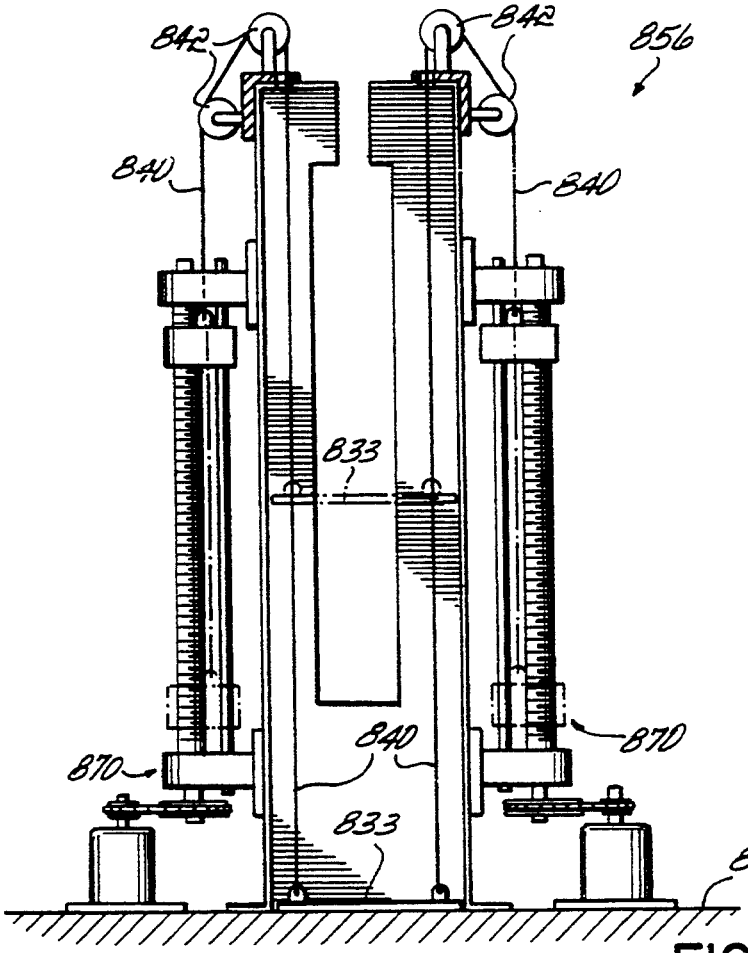
FIG. 17 is a transverse cross-sectional view depicting another variation of the fourth preferred embodiment of the invention.

FIG. 17 depicts a second variation of the fourth preferred embodiment of the invention. More particularly, FIG. 17 shows a pair of nut and bolt mechanisms 870 located on both sides of the cleaning station 856 and above the floor 828. Moreover, the nut and bolt mechanisms 870 operatively connect to an overhead pulley and cable arrangement 842 and 840 for raising or lowering the platform 833.

Figure 18:
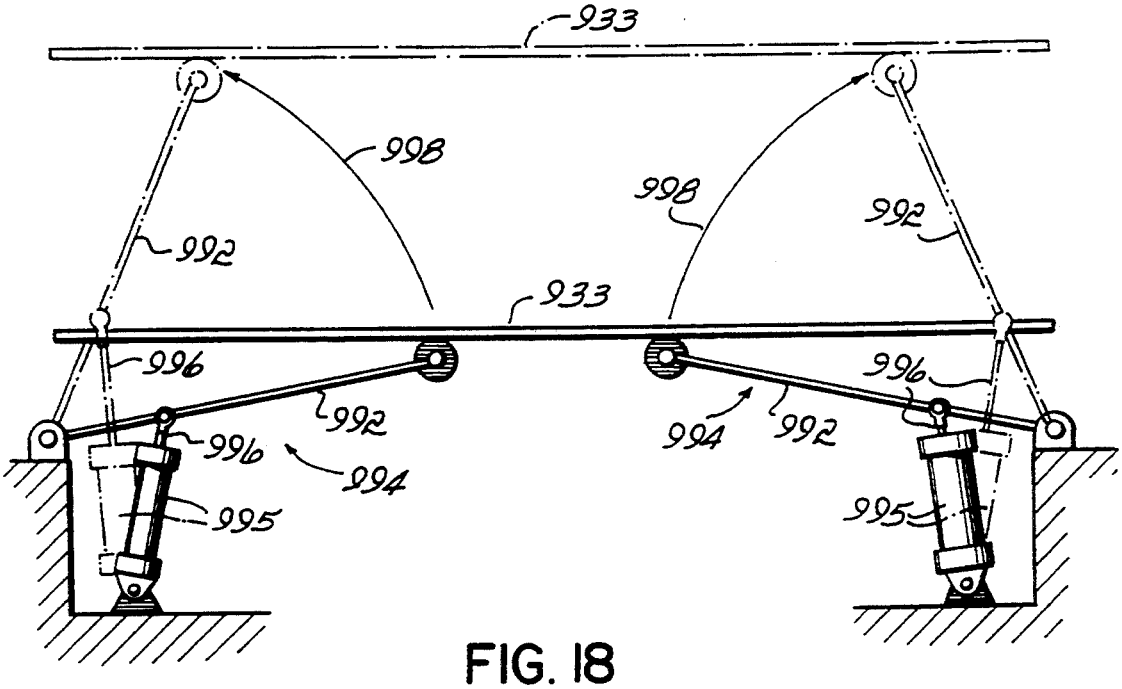
FIG. 18 is a cross sectional view which depicts a fifth preferred embodiment of the invention.

FIG. 18 shows a fifth preferred embodiment of the invention. More particularly, FIG. 18 shows a swinging arm mechanism 994 for vertically moving the platform 933 via operation of cylinders 995 and pistons 996 which arcuately move arms 992, as shown by directional arrows 998 to raise or lower platform 933.

The invention in its broader aspects is not limited to the specific details, representative apparatus and methods, and illustrative examples shown and described. Accordingly, departures may be made from such details without departing from the spirit or scope of applicants' general inventive concept.

What is claimed is:

1. A coating apparatus comprising:

a pair of opposing, substantially vertical walls defining a body of a coating booth;

a horizontal conveyor for conveying articles along a coating line which extends between the walls, the conveyor located adjacent a top end of the booth;

a plurality of gun nozzles for coating the articles as the articles are conveyed between the walls;

a horizontal platform located between and spanning the space between the walls of the booth and below the conveyor, in vertical alignment with the coating line; and an elevator operatively connected to the platform for vertically moving the platform upwardly and downwardly between the walls, the elevator is in fixed position relative to the walls, whereby an operator on the platform may readily clean accumulated coating material from the walls of the booth.

2. The coating apparatus of claim 1 and further comprising:

coating means extending through the walls of the booth and directed toward the coating line to coat an article carried by the conveyor.

3. The coating apparatus of claim 1 wherein the elevator is located below the platform.

4. The coating apparatus of claim 1 wherein the elevator comprises a pantograph linkage.

5. The coating apparatus of claim 4 wherein the elevator further comprises:

a pressure cylinder operatively connected to the pantograph linkage.

6. The coating apparatus of claim 1 wherein the elevator further comprises:

a rack and pinion mechanism.

7. The coating apparatus of claim 1 wherein the elevator further comprises:

a nut and bolt mechanism.

8. The coating apparatus of claim 1 wherein the elevator further comprises:

a swinging arm mechanism.

9. The coating apparatus of claim 2 and further comprising:

a first rack, the walls of the booth supported on the first rack; and a second rack, the platform and the elevator supported on the second rack, the first rack straddling the second rack.

10. The coating apparatus of claim 9 and further comprising:

wheels supporting the first rack, thereby to render the coating booth horizontally movable to a cleaning station located away from the coating line.

11. The coating apparatus of claim 9 and further comprising:

wheels supporting the second rack, thereby to render the platform and elevator horizontally movable to the cleaning station.

12. A coating apparatus comprising:

a pair of opposing, substantially vertical walls defining a body of a coating booth;

a horizontal conveyor for conveying articles along a coating line which extends between the walls, the conveyor located adjacent a top end of the booth;

a plurality of gun nozzles for coating the articles as the articles are conveyed between the walls;

a horizontal platform located between and spanning the space between the walls of the booth and below the conveyor, in vertical alignment with the coating line;

an elevator operatively connected to the platform for vertically moving the platform upwardly and downwardly between the walls, whereby an operator on the platform may readily clean accumulated coating material from the walls of the booth;

a first rack, the walls of the booth supported on the first rack; and a second rack, the platform and the elevator supported on the second rack, the first rack straddling the second rack.

* * * * *